United States Patent [19]

Low

[11] Patent Number: 4,712,352

[45] Date of Patent: Dec. 15, 1987

[54] MODULAR CONSTRUCTION SYSTEM

[76] Inventor: R. Glenn Low, 1911 Meadowview Rd., Bloomington, Minn. 55420

[21] Appl. No.: 804,429

[22] Filed: Dec. 4, 1985

[51] Int. Cl.[4] ..... E04C 2/34; E04F 17/00

[52] U.S. Cl. ..... 52/809; 52/220; 52/582; 52/656

[58] Field of Search ..... 52/809, 824, 825, 829, 52/582, 802, 243, 243.1, 220, 309.11, 309.9, 309.7, 580, 36, 578, 286, 579, 656; 49/DIG. 1

[56] References Cited

U.S. PATENT DOCUMENTS

| | | | |
|---|---|---|---|
| Re. 21,816 | 6/1941 | Bonsall . | |
| 1,170,691 | 2/1916 | Skipworth . | |
| 1,995,477 | 3/1935 | Kotrbaty . | |
| 2,117,397 | 6/1941 | Bonsall | 52/809 |
| 2,869,182 | 1/1959 | White, Jr. . | |
| 3,160,245 | 12/1964 | Pavlecka | 52/275 |
| 3,160,249 | 12/1964 | Pavlecka . | |
| 3,228,158 | 1/1966 | Russell | 52/580 |
| 3,363,371 | 1/1968 | Villalobos | 52/656 |
| 3,377,756 | 4/1968 | Polhamus | 52/220 |
| 3,512,819 | 5/1970 | Morgan et al. | 52/309.11 |
| 3,546,841 | 12/1970 | Smith et al. . | |
| 3,694,975 | 10/1972 | Pollock | 52/36 |
| 3,826,056 | 7/1974 | Smith et al. . | |
| 3,828,502 | 8/1974 | Carlsson | 52/309.11 |
| 4,020,611 | 5/1977 | Amos | 49/DIG. 1 |
| 4,114,333 | 9/1978 | Jones et al. . | |
| 4,197,685 | 4/1980 | Goulish et al. | 52/582 |
| 4,223,500 | 8/1980 | Clark et al. | 52/309.7 |
| 4,548,015 | 10/1985 | Switzgable | 49/DIG. 1 |
| 4,594,831 | 6/1986 | Winyard | 49/DIG. 1 |

OTHER PUBLICATIONS

Brochure on "The Lenap System by Atlas" (one page).
Brochure from J-Deck, Inc. (one page).

*Primary Examiner*—William F. Pate, III
*Assistant Examiner*—Michael Safavi
*Attorney, Agent, or Firm*—Merchant, Gould, Smith, Edell, Welter & Schmidt

[57] ABSTRACT

The modular construction system includes a plurality of lightweight, load-bearing composite panels to be used in the walls, ceilings and/or roofs of buildings, as well as for partitions within a given building. Each panel includes sheet-like skins with a foamed plastic core therebetween. At each end of the panel is a structural unit that is fabricated from sheet stock, the structural unit including a transverse section having a longitudinal groove formed therein. When two panels are abutted in an end-to-end relationship, the grooves form a conduit for electrical wiring, communication lines and plumbing. Each structural unit also has a thermal barrier so that the structural unit is resistant to the transmission of heat therethrough. The panels are connected in their end-to-end relationship by means of interfitting lugs and slots on the structural units. Additional structural units extend across the top and bottom of each panel. The ends of the structural units are interconnected through the agency of additional lugs and slots to form a frame to which the skins are adhered and between which the formed plastic core material is introduced.

7 Claims, 4 Drawing Figures

MODULAR CONSTRUCTION SYSTEM

BACKGROUND OF THE INVENTION

1. Field of the Invention

This invention relates generally to a modular system for constructing buildings and partitioning them, and pertains more particularly to such a system using panels which contain within themselves all elements required to support weight and provide insulation confined by an interior and exterior skin.

2. Description of the Prior Art

The use of composite panels utilizing a core of foam insulation and various types of facing or skin material, of course, are not new. While such panels possess some load-bearing capabilities, such capabilities are considerably restricted. Building codes have not accepted these panels as being sufficient in and of themselves for use in "stand alone" environments. When this type of panel is used in a wall construction, some form of separate supporting structure must be used in order to provide sufficient load-carrying capabilities for the wall. Likewise, when used in roof constructions, the panels are applied over rafters.

Consequently, there remains a real need for a construction system utilizing panels that do not require an added supporting structure, such as posts, studs, beams and braces which add appreciably to the material and on-site assembly costs.

The composite or laminated panels found on the market today have represented to a large degree a compromise between a fully acceptable panelized construction system and the inefficiency and costliness of the widely used stick-built construction that has been employed for many years.

SUMMARY OF THE INVENTION

A general object of my invention is to provide a modular construction system that will reduce the on-site construction costs, whether such construction is associated with the erection of an entire building or in the assembly of partitions within a particular building. In this regard, an aim of the invention is to fabricate individual panels at the factory in such a way that they can be assembled very rapidly and with little effort at the location where they are used.

Also, the invention has for an object the fabrication of the panels at the factory, utilizing techniques that minimize the cost of labor and materials, the factory-derived savings being in addition to the savings in costs by reason of the reduced time and effort in assembling the panels after they have been shipped from the factory to the site where they are to be utilized.

A very important object of my invention is to provide individual panels that when connected together can withstand normal load conditions. In this regard, it is within the purview of my invention to employ load-bearing structural units along all four edges of the panel. In this way, the structural units at the ends of the panel, when fastened together, obviate the need for individual studs, posts, splines or braces of any kind. Also, the structural units, when the panels are fastened together, are completely concealed. Still further, the structural unit extending along the top and the one extending along the bottom, provide added rigidity that can be utilized in connecting either the upper ends or the lower ends of the panels to superjacent or subjacent structures.

Another important object of the invention is to employ structural units at the opposite ends of the panels such that when one end of a panel is connected or fastened to another panel vertical voids are formed that can be used as raceways for electrical wiring, communication lines and piping.

Yet another object of the invention is to provide load-bearing panels that are extremely light in weight. In this regard, the panels are fabricated with structural units that are of a thin wall construction. Coupled with the lightweight character of the structural units is the use of a foamed core faced on opposite sides with relatively thin and inexpensive covering skins. The unique structural units in combination with the foamed core and overlying skins or facing material produce an exceptionally lightweight, yet rugged, modular unit.

Still further, the invention has for an object the use of thermal barriers and weather seals which make the panel walls and roofs weathertight without requiring on-the-job caulking or filling. Thus, a panel constructed in accordance with the teachings of my invention will be energy efficient, thereby reducing the amount of heat required in cool weather and the amount of air conditioning needed in warm weather.

Briefly, my invention envisages the employment of structural units extending along all four edges of a panel, the structural units being totally concealed when the panels are assembled. The structural units are fabricated of thin wall metal in the form of two channel members. One leg section of one channel member has a groove formed therein, this leg section extending transversely toward an inwardly directed leg section belonging to the other channel member but terminating in a space relationship therewith so as to permit the use of a thermal barrier between the free edges of these two leg sections. The other leg sections of the two channel members in each instance are spaced so that the foamed plastic insulating material constituting the core can pass therebetween and into the void formed by the two channel members. The channel members included in the structural unit of one end of each panel are provided with projecting lugs and the channel members forming the structural unit of the opposite end of each panel are provided with slots so that the panels can be fastened together at the job site by means of the lugs and slots when arranged in an end-to-end relationship. Additional lugs and slots are employed to connect the top structural unit to the two vertical end structural units at the factory and likewise additional lugs and slots are used to connect the bottom structural units to the lower ends of the vertical units during the fabrication process. In this way, a skeleton-type frame is formed and when the skin or facing members, such as sheets of appropriate hardboard, are held against the resulting frame, the introduction of foamed plastic will cause the space between the skins to fill and also the space within the structural units extending along the four sides of the frame.

Although my invention will hereinafter be described in conjunction with a panelized modular wall construction system, it will be recognized that the invention can be used to form the ceiling for a room or the roof of a building. In other words, the individual panels are fabricated so that they can be interconnected vertically, such as when erecting the wall of a building or a partition within a building, horizontally when constituting the ceiling of a room, or at an inclination when forming the roof of a dwelling.

DESCRIPTION OF THE PREFERRED EMBODIMENT

Figure 1:
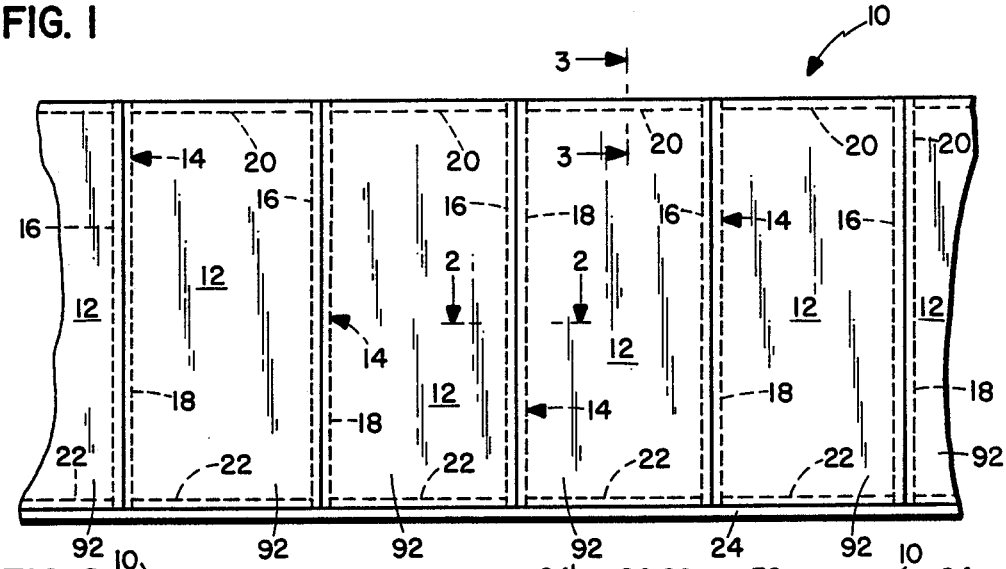
FIG. 1 is a front elevational view of a modular construction system exemplifying my invention, the construction being in the form of a wall.

Although my invention can be used in the construction of ceilings and roofs, FIG. 1 depicts a wall construction utilizing the modular techniques of my invention, the wall construction being indicated generally by the reference numeral 10. More specifically, the wall construction 10 includes four complete panels 12 and two fragmentarily pictured panels 12. Each of the panels 12 is of identical construction. In this regard, each panel 12 includes a frame 14 comprised of a vertical structural unit 16 at the right end thereof, and a vertical structural unit 18 at the left end thereof, the unit 18 being virtually a mirror image of the unit 16. Additionally, there is a structural unit 20 at the top and a structural unit 22 at the bottom of each frame. As the description progresses, it will be appreciated that the units 20 and 22 can be identical to each other, and also virtually identical to either the unit 16 or the unit 18. Although no top plate is shown in FIG. 1, a sole plate or bottom plate 24 underlies the bottom unit 22 of the panels 12.

Figure 2:
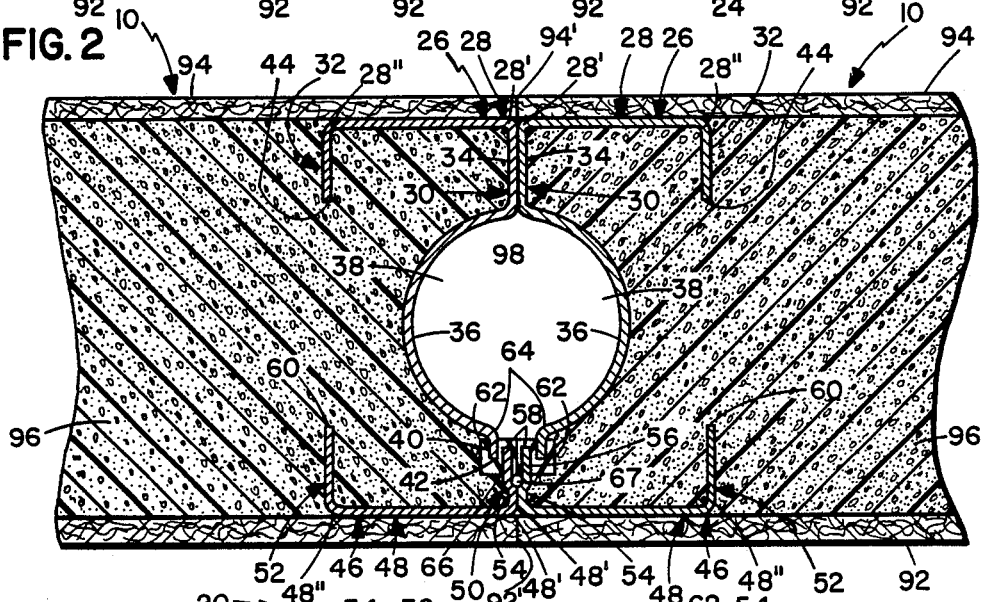
FIG. 2 is an enlarged sectional view taken in the direction of line 2—2 of FIG. 1 for the purpose of illustrating the construction of two structural units and the manner in which they butt together.
Figure 3:
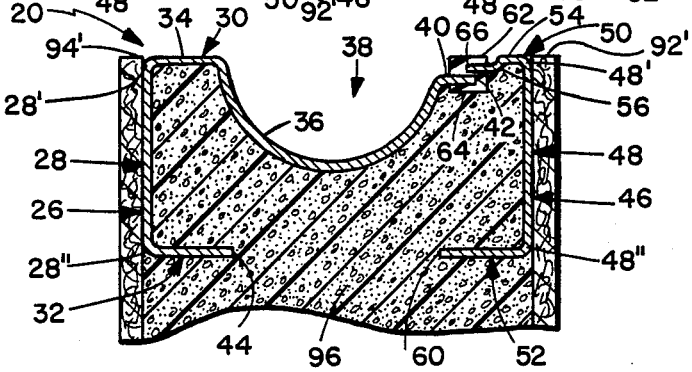
FIG. 3 is a sectional detail taken in the direction of line 3—3 of FIG. 1 in order to show the similarity between the structural unit extending horizontally along the top of each panel and the vertical structural units at the ends of the panels (as in FIG. 2)
Figure 4:
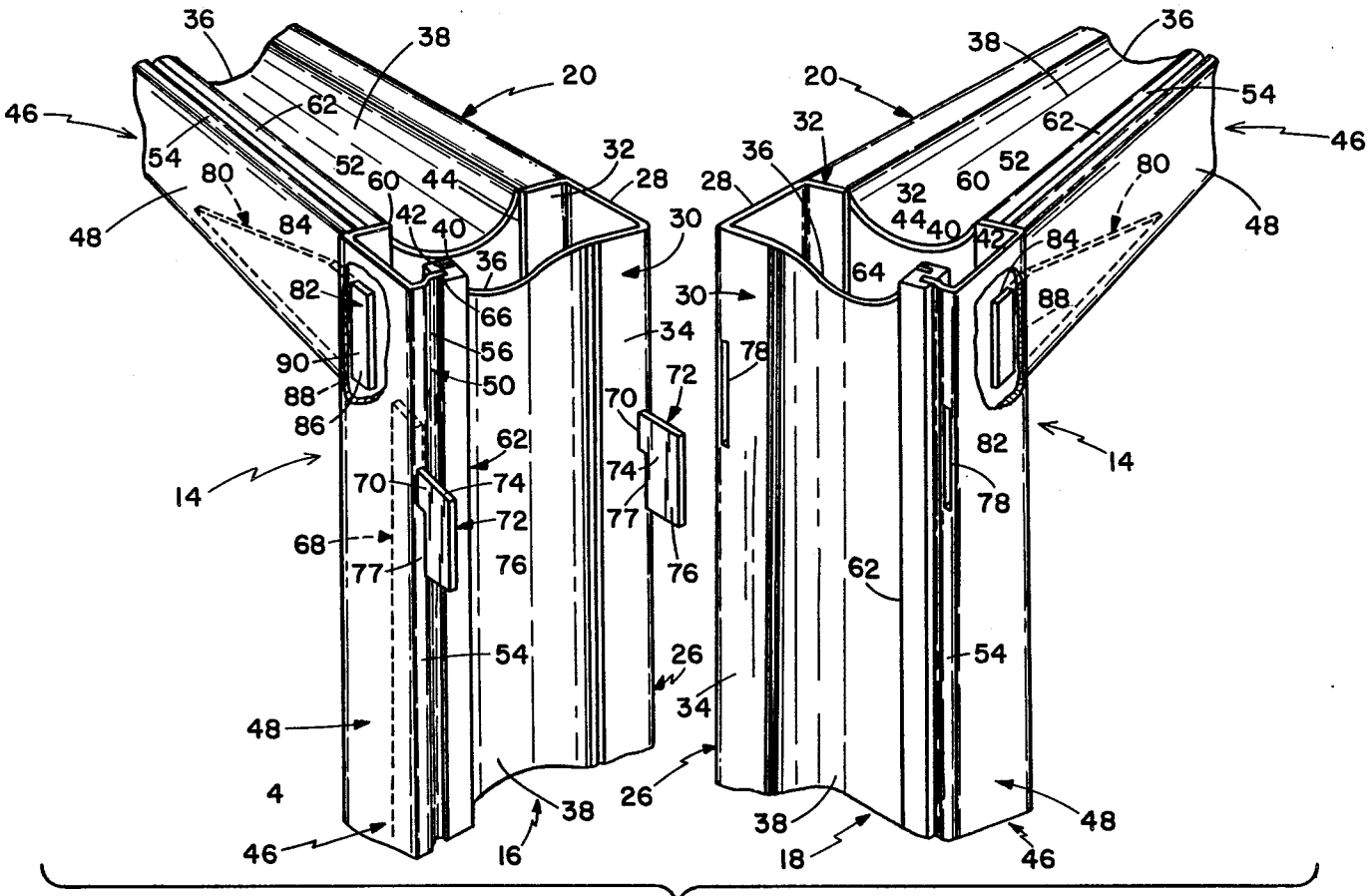
FIG. 4 is an open book perspective view of the portions of two skeleton-type frames, without either skin having been applied and without any foamed plastic having been introduced, the view not only depicting the manner in which the frames are fabricated but also the manner in which the finalized panels are interconnected by the lug and slot arrangement appearing in this view.

The similarity between the structural units 16 and 18 can be readily appreciated from FIG. 2, and also from FIG. 4. Owing to this similarity, it will be easier to assign the same reference numeral to each corresponding part. Consequently, there is a first channel member 26 of sheet metal that includes a web section or side plate member 28, a first leg section 30 and a second leg section 32. The first leg section 30 includes a strip portion 34 having a semicircularly curved inwardly protruding conduit defining portion 36 forming a longitudinal groove 38.

As shown in the drawings, strip portion 34 is a vertical edge plate member extending perpendicularly inward from an outer edge 28' of side plate member 28. (For purposes of this application, "inwardly" and "inward" will means projecting away from exterior surfaces of a panel 12.) Additionally, the first leg section 30 includes a flange portion 40 that is integral with the curved portion 36, thereby forming a free edge at 42. The second leg section 32 constitutes a flange in and of itself, extending inwardly from inner edges 28" of side plate member 28 and having a free edge labeled 44.

There is a second channel member 46 having a web section or side plate member 48, a first leg section 50 and a second leg section 52. In this instance, the first leg section 50 includes a strip portion 54 integral with the web section 48 and a flange portion 56 providing a free edge at 58.

As shown in the drawings, strip portion 54 is a vertical edge plate member extending perpendicularly inwardly from an outer edge 48' of side plate member 48. The second leg section 52 is in the form of a flange projecting inwardly from an inner edge 48" of side plate member 48 and provides a free edge 60.

It should be observed that the first leg section 30 of the channel member 26 terminates in a spaced relationship with respect to the first leg section 50 of the second channel member 46. In other words, the free edge 42 of the flange portion 40 is spaced from the free edge 58 of flange portion 56. By the same token, although to a far greater degree, the second leg section 32 of the first channel member 26 terminates in a spaced relationship with respect to the second leg section 52 of the channel member 46. Here again, the free edges 44 and 60 are spaced from each other, the spacing being quite substantial as can be learned from FIGS. 2 and 4.

At this time, attention is directed to a thermal barrier in the form of an elastomeric strip 62 having a longitudinal groove at 64 and a second longitudinal groove at 66, the grooves 64 and 66 facing in opposite directions as can be clearly perceived from FIGS. 2 and 4. The groove 64 snuggly receives therein the flange portion 40 and the groove 66 snuggly receives therein the flange portion. In this way, there is a substantial resistance to the flow of heat between the two leg sections 30 and 50, and hence inhibiting the transfer of heat from one side of the panel 12 to the other via this path. When the ends of two completed panels 12 are abutted together, as can be understood from FIG. 2, a weather seal 67 is employed between the flange portions 56.

As can be seen at the left in FIG. 4, there is a lug strip 68 appearing in phantom outline inasmuch as it is concealed by the second channel member 46 of the structural unit 16; although not shown, a second lug strip 68 is secured to the web section 28, providing additional lugs 72. The lug strip 68 has any preferred number of L-shaped lugs 72 projecting therefrom through slots 70 formed in the strip portion 54, each lug 72 having a horizontal section 74 and a vertical section 76, thereby forming a slot at 78. The lug strip 68 is secured to the web section 48, as by welding. The strip portion 34 belonging to the first channel member 26 of the structural unit 18 and the strip portion 54 of the second channel member 46 each has a number of slots 78 therein which enable the horizontal section 74 of each lug 72 to extend therethrough. In this way, the L-shaped lugs 72 of the structural unit 16 function as hooks, being engageable when inserted into the vertical slots 78 of the structural unit 18, as can be understood from FIG. 4. Although only two L-shaped lugs 72 appear in FIG. 4 and only two slots 78 appear in this figure, it will be appreciated, as already indicated, that any desired number of L-shaped lugs 72 can be vertically oriented on the unit 16 and any corresponding number of slots 78 in the unit 18 can be appropriately oriented so as to fasten the adjacent ends of two panels 12 together.

It has already been stated that the structural unit 20 is very much like, or can even be identical to, the units 16 and 18. Therefore, the portions of the two structural units 20 appearing in FIG. 4 have been assigned the same reference numerals utilized when describing the structural units 16 and 18. However, no lugs 72 or slots 78 have been shown, for the manner in which the structural units 20 are to be attached to a top plate or other superstructure depends upon the particular architectural design of the building. When the panels 12 are used as a partition, it should be understood that there would be no panels 12 thereabove and consequently there would be no need for any means for interconnecting the structural units 20 of any of the panels 12 to something thereabove. The same thing holds true for the bottom structural unit 22.

However, it should be observed from FIG. 4 that there is a lug bracket 80 that is secured as by welding, to the inner surface of the web section 48 belonging to the second channel member 46 of the structural unit 16 and a lug bracket 80 similarly secured to the web section 48 belonging to the second channel member 46 of the unit 18 Each lug bracket 80 has an L-shaped lug 82 projecting from the end thereof, the L-shaped lug 82 having a horizontal section 84 and a vertical section 86, thereby forming a slot 88. There are slots 90 in the second section 52 of the second channel member 46 of the structural unit 16 and also in the section 52 of the second channel member 46 of the unit 18. Although not shown, there is a second lug bracket 80 secured to the web section 28 of each channel member 26. Thus, when initially connecting the various structural units 16, 18, 20 and 22 together to provide a frame 14, the L-shaped lugs 82 are inserted into the slots 90 to produce each frame 14.

Interior and exterior skin or facing sheets 92 and 94, such as tempered fiberboard, have marginal portions thereof overlying the sections 48 and 28, respectively, of the channel members 46 and 26. and presenting vertical edges 92', 94', respectively, in planar alignment with edges 54 and 34 Actually, these skins 92, 94 are suitably adhered to the web sections 48, 28 before introducing any foamed plastic 96, such as polyurethane, into the void between the skins 92, 94, and also within the space formed within the various structural units 16, 18, 20 and 22. It will be appreciated, especially from FIG. 2, that the foamed plastic, while still molten enters the voids of the units 16–22 between the second sections 32 and 52 of the two channel members 26 and 46.

It should be appreciated that when the panels 12 are assembled, that is placed end to end, there is a vertically oriented cylindrical conduit or raceway 98 formed by reason of the two curved portions 36. This void or raceway 98 can readily accommodate electrical wiring, communication lines and/or piping. In this regard, the upper ends of the curved portions 36 of the structural units 16 and 18 are curved downwardly so as to conform to the curved portions 36 of the horizontal structural units 20. More specifically, such a conformity enables whatever wiring or piping is contained in the vertical conduit 98 to pass into either or both grooves 38 in the units 20. During the forming procedure, the upper ends of the structural units 16 and 18 would be suitably blocked and such a blocking means would include a semicylindrical portion thereon so that communication is established between the conduit 98 and the horizontal grooves 38 in the units 20.

I claim:

1. A panel for a modular wall assembly comprising:

a frame (14) having a first vertical structural unit (16) and a second vertical structural unit (18) and connecting means (20, 22) for rigidly connecting said first structural unit (16) to said second structural unit (18);

each of said structural units having a pair of generally parallel spaced apart first and second side plate members (28, 48) and a pair of vertical edge plate members (34, 54) perpendicular to said side plate members with a first (34) of said edge plate members extending inwardly from an outer edge (28') of said first side plate member (28) and with a second (54) of said edge plate members extending inwardly from an outer edge (48') of said second side plate member (48); at least one (34) of said edge plate members having an inwardly protruding conduit defining portion (36) disposed spaced from said side plates (28, 48); thermal barrier means (62) for rigidly connecting free ends (42, 58) of said edge plate (34, 54) members in thermally insulated connection;

facing sheets (92, 94) secured to outer surfaces of said side plate members (28, 48) of said first structural unit and extending to and secured to outer surfaces of side plate members of said second unit;

fastening means (72, 78) disposed completely between said facing sheets (92, 94) for rigidly connecting said first structural unit of said panel to a second structural unit of a contiguous panel with vertical edge plate members (34, 54) of said panel and said contiguous panel abutting and with opposing conduit defining portions (36) having opposing surfaces defining a completed conduit (98) disposed between said facing sheets (92) and in spaced relation thereto;

said thermal barrier means including a first thermal barrier element connecting edge plate members of said first structural unit (16) and a separate second thermal barrier element connecting edge plate members of said second structural unit (18), said first and second thermal barrier elements disposed to define a first thermal barrier of said panel and a second thermal barrier of said contiguous panel so as to abut when said panel and said continguous panel are joined edge to edge to form a composite panel with abutting thermal barrier elements defining a composite thermal barrier; and rigid foam insulation disposed within said panel and filling a volume defined by opposing surfaces of said facing sheets (92), side plate members (28, 48) and edge plate members (34, 54).

2. A panel according to claim 1 wherein said fastening means includes a plurality of lugs projecting from said edge plate members of said first structural unit, a plurality of lug receiving slots formed within said edge plate member of said second structural unit and said slots aligned to received lugs projecting from a first structural unit of a contiguous panel, said lugs disposed within slots of said contiguous panel to connect said panel to said contiguous panel in opposition to forces acting transverse to said panel.

3. A panel according to claim 2 wherein each of said edge plate members of said first structural unit are provided with a plurality of slots formed therethrough, lug strips secured to inner surfaces of each of said side plate members of said first structural unit and a plurality of lugs integral with each of said lug strips and passing through said slots formed in said edge plate members of said first structural unit.

4. A panel according to claim 1 wherein said facing sheets are provided with vertical edges (92') disposed in general planar alignment with an adjacent vertical surface of said edge plate members (34,54) whereby opposing vertical edges 92' of contiguous panels will about in face-to-face contact when said panels are fastened together.

5. A panel according to claim 1 wherein said connecting means includes a top structural unit extending between upper ends of said first and second vertical structural units, means for connecting said top structural unit to upper ends of said first and second vertical unit, said top structural unit having an inwardly protruding conduit defining portion extending between said first and second structural units, said conduit defining portions of said first and second structural units terminating in spaced relation from upper ends of said first and second structural units whereby an uninterrupted conduit may be formed extending from said first structural unit through said top structural unit and into said second structural unit.

6. A panel according to claim 5 wherein each of said side plate members of said first and second structural unit are provided with inwardly projecting legs (32, 52) at inner edges (28'', 48'') of said side plate members;

slots formed through said legs (32, 52) at upper edges of said first and second structural members;

lugs secured to said top structural member and aligned tobe received within said slots formed in said legs (44, 52).

7. A panel according to claim 1 wherein said first and second vertical edge plate members are in planar alignment.

* * * * *